US005200305A

United States Patent [19]

Schumann et al.

[11] Patent Number: 5,200,305

[45] Date of Patent: Apr. 6, 1993

[54] COLOR PHOTOGRAPHIC RECORDING MATERIAL CONTAINING COLOR COUPLERS WHICH YIELD HEAT-STABLE DYES

[75] Inventors: Hans-Joachim Schumann, Cologne; Erich Wolff, Solingen, both of Fed. Rep. of Germany

[73] Assignee: Agfa Gevaert Aktiengesellschaft, Leverkusen, Fed. Rep. of Germany

[21] Appl. No.: 589,168

[22] Filed: Sep. 27, 1990

[30] Foreign Application Priority Data

Oct. 11, 1989 [DE] Fed. Rep. of Germany ..... 3933899

[51] Int. Cl.[5] ..... G03C 7/34

[52] U.S. Cl. ..... 430/505; 430/552; 430/553

[58] Field of Search ..... 430/552, 553, 505

[56] References Cited

U.S. PATENT DOCUMENTS

| | | | |
|---|---|---|---|
| 4,333,999 | 6/1982 | Lau | 430/553 |
| 4,513,082 | 4/1985 | Furutachi et al. | 430/552 |
| 4,609,619 | 9/1986 | Katoh et al. | 430/553 |
| 4,690,889 | 9/1987 | Saito et al. | 430/553 |
| 4,865,961 | 9/1989 | Miura et al. | 430/553 |
| 4,929,539 | 5/1990 | Sato et al. | 430/553 |
| 4,983,503 | 1/1991 | Ishikawa et al. | 430/553 |

*Primary Examiner*—Richard L. Schilling
*Attorney, Agent, or Firm*—Connolly & Hutz

[57] ABSTRACT

A color photographic material containing color couplers which yield heat-stable dyes.

A color photographic recording material containing cyan couplers which, during chromogenic development, yield cyan dyes having parameters a and b such that $$a.(1+b) \leqq 1.5$$

are suitable for the production of color negatives for multicopy operation in which a plurality of identical copies are successively prepared from the same original.

In the above condition:

a is the temperature coefficient of the absorption $$A_{(T=23^\circ C.)} = \lg \frac{I_o}{I}$$

$$a = -\left[\frac{1}{A}\right] \cdot \left[\frac{\Delta A}{\Delta T}\right] \cdot 1{,}000$$

and b is the temperature coefficient of the absorption wavelength $\lambda_{(T=23^\circ C.)}$ $$b = -\left[\frac{1}{\lambda}\right] \cdot \left[\frac{\Delta \lambda}{\Delta T}\right] \cdot 1{,}000.$$

2 Claims, 4 Drawing Sheets

A
1,6
1,2
0,8
0,4
0,0
0
500
600
700
800
λ [nm]
900
1
2

A
1,6
1,2
0,8
0,4
0,0
0
500
600
700
800
λ [nm]
900
1
2

COLOR PHOTOGRAPHIC RECORDING MATERIAL CONTAINING COLOR COUPLERS WHICH YIELD HEAT-STABLE DYES

This invention relates to a color photographic multilayer recording material containing at least three silver halide emulsion layers each sensitive to one of the three main spectral regions red, green and blue and associated color couplers for forming the component dye images of complementary color, namely cyan, magenta and yellow. By virtue of the particular structure of the image dyes formed from the color couplers during chromogenic development, the photographic recording material according to the invention does not produce any temperature-induced color tinges in the paper copies in the normal operation and particularly in the multicopy operation of high-performance (scan) printers.

It is known that high-performance quartz halogen lamps having a radiant power of approximately 100,000 to 400,000 lux are advantageously used in the production of paper copies in high-performance (scan) printers, for example the AGFA MSP, GRETAG 3140, both at the measuring station for determining the exposure time and at the copying station itself.

Through the absorption of the image dyes, the light energy is converted into heat energy so that the negative used as the original can become heated to 45° C. and higher. Although filters can be added during measurement and exposure, they still show residual permeability, even in the filtered-out region, in view of the high radiant power.

In addition, radiant power increases considerably from the blue to the red and infrared spectral region (FIG. 1), so that the cyan dyes in particular, which absorb red light, contribute towards the heating of the original.

The IR thermal radiation is best removed by means of heat-shield filters (SCHOTT, Mainz) or is eliminated by passing the light beam through a water filter.

The heating effect cannot be completely prevented by forced cooling because the heat is developed in situ in the layers of the original and, because of inadequate contact, can only be dissipated (with minimal effect) via the air.

It has been found that the heating of the original more or less has the effect of altering the absorption of the image dyes in the negative, absorption generally decreasing with increasing temperature, and of shifting the absorption band, generally to shorter wavelengths. This effect is particularly serious in the absorption of the cyan component dye image.

Typical changes in density in the exposure station of a high-performance (scan) printer for the cyan layer are, for example, $\Delta D = -0.15$ starting from a density D of 2.0. In the 100th copy for example, this is equivalent to an increase in the cyan density from D =0.7 to D =0.8 (color tinge).

In the multicopy operation of high-performance (scan) printers, the original is scanned only once to determine the exposure time and filtering for a plurality of identical copies, after which the corresponding number of copies is printed with these fixed data. The original becomes increasingly warmer in a short time during the repeated exposure. This leads to a reduction in density in the original and, hence, to increasing over-exposure of the copy (color tinge). This error does not of course occur when only one copy of the original is being made or in the first copy of a plurality of copies successively made from the same original, but only when heating has occurred in the original in consequence of repeated exposure.

The problem addressed by the present invention is to provide a color photographic negative recording material from which it is possible to prepare a negative in which the image dyes show better thermal stability and which is therefore more suitable as an original in the production of color copies, particularly in a high-performance (scan) printer.

A color photographic negative recording material has now been found which contains special cyan couplers that yield cyan dyes having better thermal stability during chromogenic development. The recording material according to the invention is particularly adapted and suitable for processing in high-performance (scan) printers, above all in multicopy operation, i.e. when a plurality of identical copies are successively prepared from the same original.

SUMMARY OF THE INVENTION

The present invention relates to a color photographic recording material which contains on a transparent layer support at least one red-sensitive silver halide emulsion layer and a cyan coupler of the naphthol or phenol type associated therewith, at least one green-sensitive silver halide emulsion layer and a magenta coupler of the 5-pyrazolone or pyrazoloazole type associated therewith and at least one blue-sensitive silver halide emulsion layer and a yellow coupler of the acylacetanilide type associated therewith, characterized in that the following condition applies to the cyan dye formed from the cyan coupler in the layer during chromogenic development:

$$a\cdot(1+b)\leqq 1.5$$

where a is the temperature coefficient of the absorption $$A_{(T=23^\circ C.)} = \lg\frac{I_o}{I}$$

$$a = -\left[\frac{1}{A}\right]\cdot\left[\frac{\Delta A}{\Delta T}\right]\cdot 1{,}000$$

and b is the temperature coefficient of the absorption wavelength $\lambda_{(T=23^\circ C.)}$ $$b = -\left[\frac{1}{\lambda}\right]\cdot\left[\frac{\Delta\lambda}{\Delta T}\right]\cdot 1{,}000$$

$I_o$ and I represent the spectral radiant flux respectively in front of and behind the sample.

The temperature coefficient a describes the temperature dependence of the absorption A of the absorption band and is the change in absorption $\Delta A$ per degree standardized to the absorption A at 23° C.

The temperature coefficient b describes the temperature dependence of the position $\lambda_{max}$ of the absorption band and is the spectral change $\Delta\lambda$ per degree standardized to the wavelength $\lambda_{max}$ at 23° C.

DETAILED DESCRIPTION OF THE INVENTION

The present invention also relates to a process for the preparation of a plurality of identical positive dye images from a transparent original, preferably in a high-performance (scan) printer, in which the original is line-scanned once to determine the necessary exposure and filter data, after which a plurality of different sections of a color photographic print material are successively exposed through the same original on the basis of the exposure and filter data thus determined and are then chromogenically developed and in which, to prepare a transparent original, a color photographic recording material is used which contains on a transparent layer support at least one red-sensitive silver halide emulsion layer and a cyan coupler of the naphthol or phenol type associated therewith, at least one green-sensitive silver halide emulsion layer and a magenta coupler of the 5-pyrazolone or pyrazoloazole type associated therewith and at least one blue-sensitive silver halide emulsion layer and a yellow coupler of the acylacetanilide type associated therewith and which is exposed to form an image and then chromogenically developed in the usual way, characterized in that the following condition applies to the cyan dye formed from the cyan coupler in the layer during chromogenic development:

$$a\cdot(1+b)\leqq 1.5$$

where a is the temperature coefficient of the absorption $$A_{(T=23^\circ C.)} = \lg\frac{I_o}{I}$$

$$a = -\left[\frac{1}{A}\right]\cdot\left[\frac{\Delta A}{\Delta T}\right]\cdot 1{,}000$$

and b is the temperature coefficient of the absorption wavelength $\lambda_{(T=23^\circ C.)}$ $$b = -\left[\frac{1}{\lambda}\right]\cdot\left[\frac{\Delta\lambda}{\Delta T}\right]\cdot 1{,}000$$

The color photographic recording material according to the invention is thus a negative material which differs from conventional negative materials solely in the fact that it contains special color couplers, more particularly cyan couplers, which have the properties defined in the claim. In the cyan couplers according to the invention the temperature coefficient of the absorption A is preferably $0\leqq a\leqq 1.4$ and the temperature coefficient of the absorption wavelength $\lambda$ is preferably $0\leqq b\leqq 0.18$.

The significance of the invention lies in the fact that the absorption properties of the image dyes produced from the color couplers during chromogenic development are largely independent of the ambient temperature over the temperature range from 10° to 60° C. so that the copying results are only slightly influenced by a change in temperature within that range. In normal copying, only a few copies, generally about 1 to 3, are made from a negative original, the negative being heated only slightly by the copying light.

By contrast, in so-called multicopy operation, the heating of the negative through repeated exposure to the copying light is considerably greater if the same negative is repeatedly exposed over a short period and the heat produced is not dissipated sufficiently quickly.

In the case of the couplers used hitherto, this produced an increasing change in the absorption properties in the negative with increasing temperature which was reflected in a clear color tinge in the $n^{th}$ copy by comparison with the first copy. By contrast, where the color photographic negative material according to the invention is used, hardly any color deviation is noticeable, even in the production of a plurality of copies. In the context of the invention, a plurality of copies means more than 5, preferably more than 10 and, most preferably, more than 50.

The transparent color negative used as original in the process according to the invention is prepared by chromogenic development of an exposed color photographic (negative) recording material containing the cyan, magenta and yellow couplers mentioned above, at least one of the cyan couplers used being one of which the dye is governed by the above-mentioned condition. The same condition preferably also applies to the dyes produced from the magenta and yellow couplers used during chromogenic development.

Naphtholic cyan couplers correspond to formula I

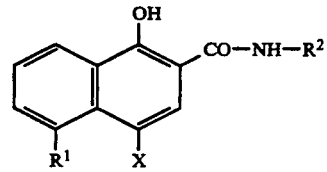

(I)

in which $R^1$ represents H, —Z—$R^3$ or —NH—$R^4$;

Z represents —O—, —S(O)$_m$— or —$SO_2$—NH—;

m has the value 0, 1 or 2;

$R^2$ represents alkyl or aryl with a ballast group;

$R^3$ represents H, —$CF_3$, alkyl, aryl or a heterocyclic group;

$R^4$ represents H or acyl;

X represents H, halogen or a group releasable during the color coupling reaction.

Cyan couplers of the phenol type preferably used in accordance with the invention are, for example, those of the 2-ph-enylureidophenol type and, more particularly, those corresponding to formula II

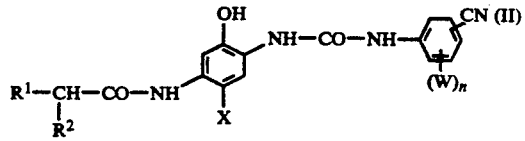

in which

W represents H or another substituent;

n has a value of 1 to 4;

$R^1$ represents a phenoxy group which has at least one unsubstituted o-position on the phenyl ring and, in addition, may be substituted by 1 to 3 substituents from the group consisting of $C_{1-3}$ alkyl, alkoxy or cycloalkyl;

$R^2$ represents alkyl containing at least 8 C atoms, preferably in a straight chain;

X represents hydrogen, halogen or a group releasable during the color coupling reaction.

An alkyl group present at the phenoxy group represented by $R^1$ is preferably methyl or isopropyl; an alkoxy group is preferably methoxy; a cycloalkyl group is preferably cyclohexyl.

Examples of cyan couplers according to the invention are given in Example 1, Table 1 (couplers C-1 to C-8).

Magenta couplers of the 5-pyrazolone type preferably correspond to formula IIIa or IIIb IIIa

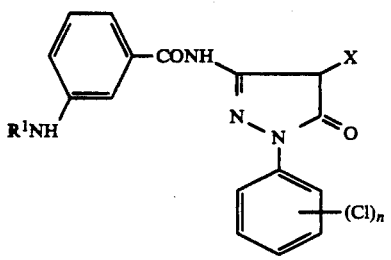

IIIb

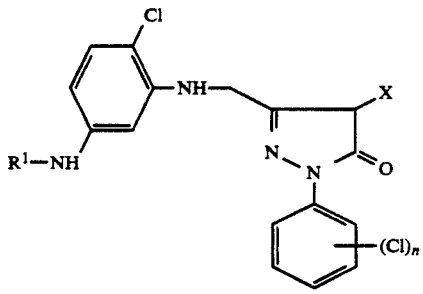

in which $R^1$ represents an acyl radical and

X represents H, halogen or a group releasable during the color coupling reaction and n is an integer of 1 to 3.

Magenta couplers of the pyrazoloazole type correspond to formula IV (IV)

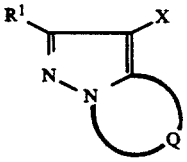

in which $R^1$ represents alkyl, aralkyl or aryl;

X represents H, halogen or a group releasable during the color coupling reaction and Q represents a group for completing a fused, unsaturated, optionally substituted 5-membered ring containing a total of 2, 3 or 4 N atoms.

The coupling group in the pyrazoloazole couplers corresponding to formula IV is, for example, a group of the imidazolo[1,2-b]pyrazole, imidazolol[3,4-b]pyrazole, pyrazolo[2,3-b]pyrazole, pyrazolo[3,2-c]1,2,4-triazole, pyrazolo[2,3-b]-1,2,4-triazole, pyrazolo[2,3-c]-1,2,3-triazole or pyrazolo[2,3-d]tetrazole type. The corresponding structures are represented by formulae IV-1 to IV-7 below:

IV-1

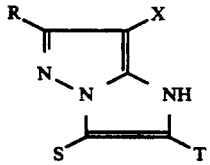

IV-2

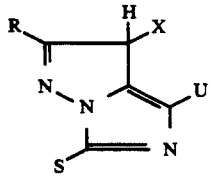

IV-3

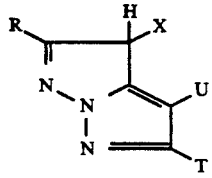

IV-4

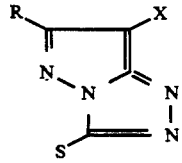

IV-5

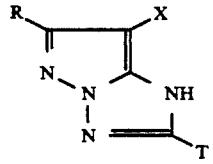

IV-6

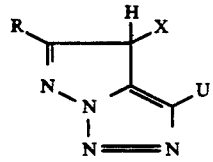

IV-7

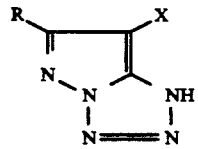

In general formula IV-1 to IV-7, the substituents R, S, T and U represent hydrogen, alkyl, aralkyl, aryl, alkoxy, aroxy, alkylthio, arylthio, amino, anilino, acylamino, cyano, alkoxycarbonyl, carbamoyl, sulfamoyl, which may in turn be substituted and, for example, may contain a ballast group. In formula IV-1, S and T together may also represent a group for completing a fused, optionally substituted benzene ring.

The following are suitable examples of magenta couplers:

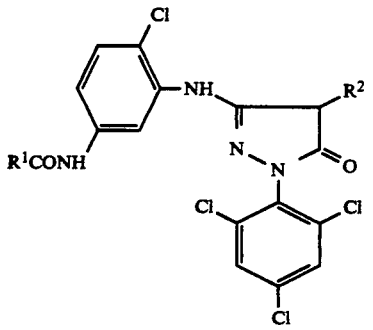
M-1
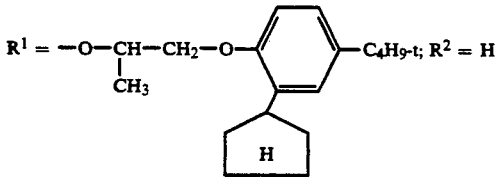
M-2
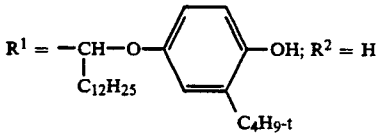
M-3
$R^1 = -C_{13}H_{27}$; $R^2 = H$
M-4
$R^1 = -OC_{16}H_{33}$; $R^2 = H$
M-5
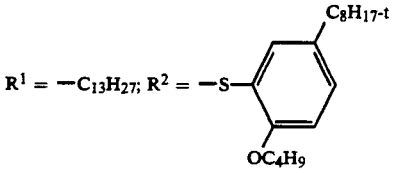
M-6
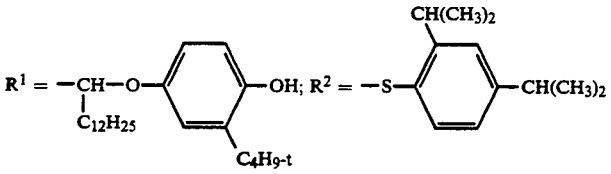
M-7
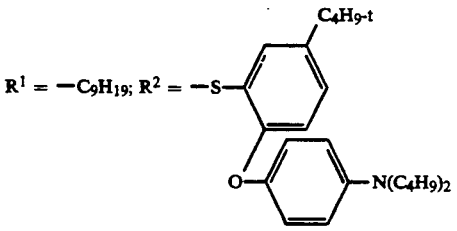
M-8
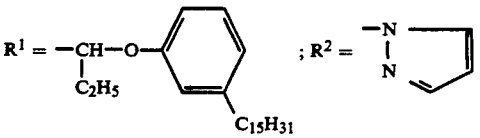

-continued
M-9
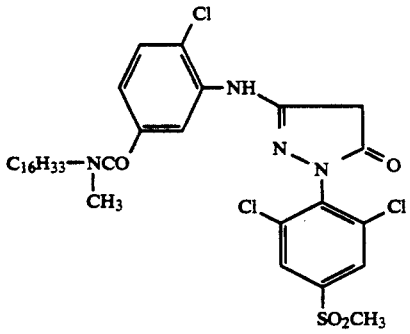
M-10
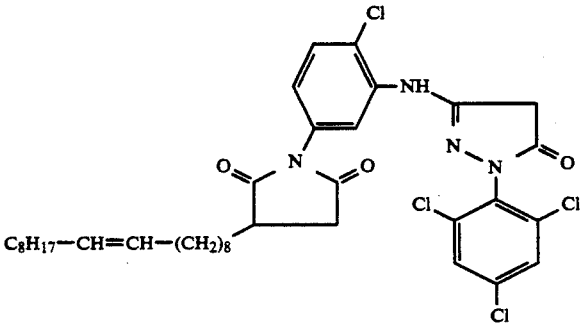
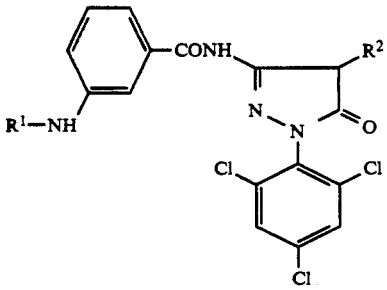
M-11
$R^1 = -SO_2-C_6H_4-OC_{12}H_{25}$; $R^2 = H$
M-12
$R^1 = -CO-CH_2-O-C_6H_3(C_5H_{11}\text{-}t)-C_5H_{11}\text{-}t$; $R^2 = H$
M-13
$R^1 = -CO-CH(C_2H_5)-O-C_6H_3(C_5H_{11}\text{-}t)-C_5H_{11}\text{-}t$; $R^2 = H$
M-14
$R^1 = -CO-CH(C_2H_5)-O-C_6H_3(C_5H_{11}\text{-}t)-C_5H_{11}\text{-}t$;
$R^2 = -O-C_6H_4-COOC_2H_5$ -continued
M-15
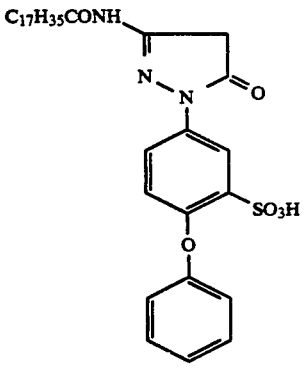
M-16
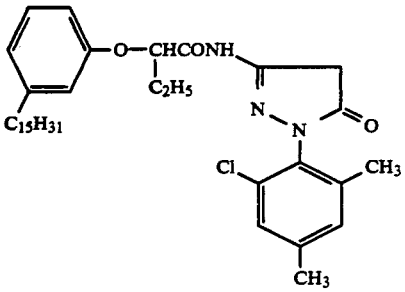
M-17
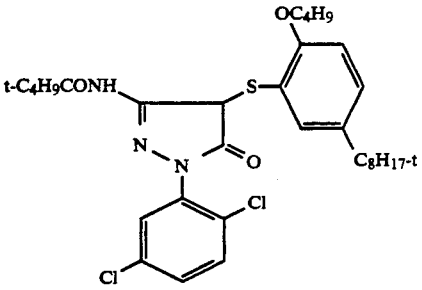
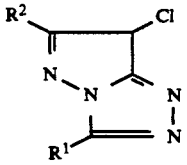
M-18
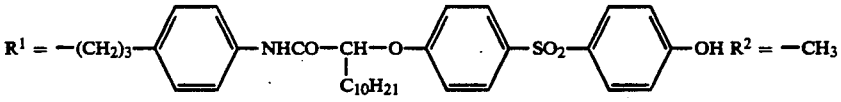
M-19
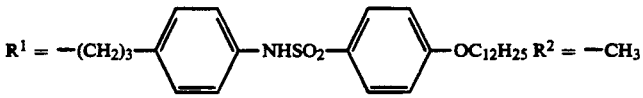
M-20
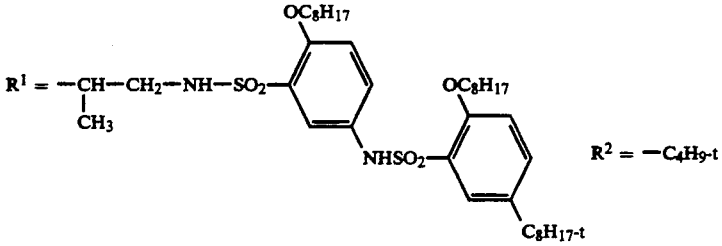

-continued

M-21

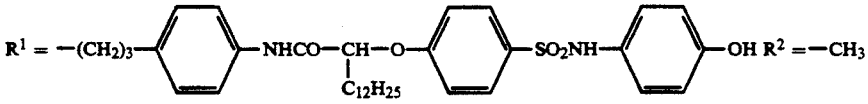

M-22

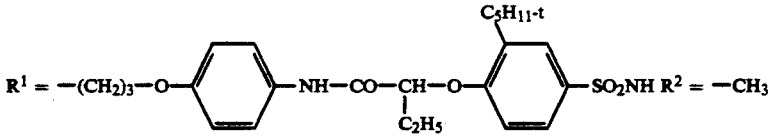

M-23

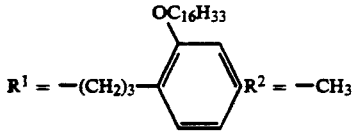

M-24

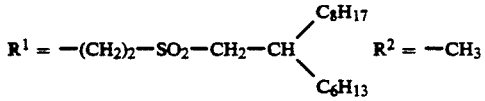

M-25

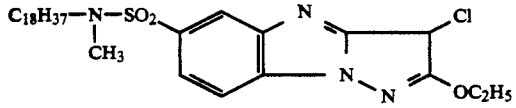

Yellow couplers of the acylacetanilide type correspond to formula V

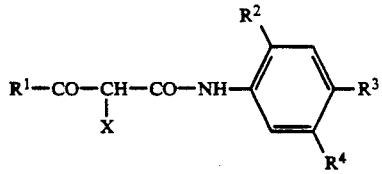

(V)

in which $R^1$ represents alkyl or aryl, more particularly t-butyl or phenyl; the phenyl ring may be substituted, for example by alkoxy;

$R^2$ represents hydrogen, halogen, alkoxy, aryloxy, alkylamino;

$R^3$ represents hydrogen, halogen, alkoxy, dialkylamino, acylamino, sulfamoyl, alkylcarbamoyl, alkoxycarbamoyl;

$R^4$ has the same meaning as $R^3$.

Suitable examples of yellow couplers are α-benzoylacetanilide couplers and α-pivaloylacetanilide couplers corresponding to the following formulae:

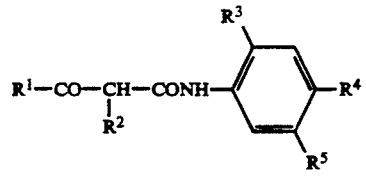

$R^1 = -C_4H_9$-t; Y-1

-continued

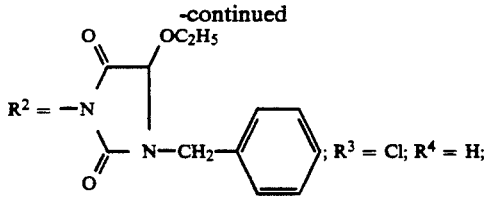

; $R^3$ = Cl; $R^4$ = H;

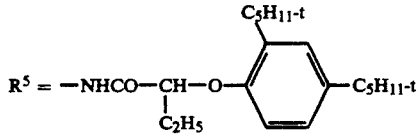

$R^1 = -C_4H_9$-t; Y-2

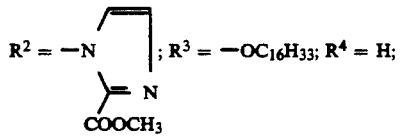

; $R^3 = -OC_{16}H_{33}$; $R^4$ = H;

$R^5 = -SO_2NHCH_3$ $R^1 = -C_4H_9$-t; Y-3

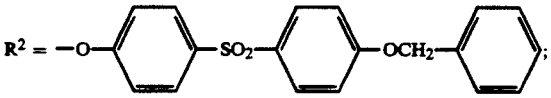

;

$R^3$ = Cl $R^4$ = H; $R^5 = -NHSO_2-C_{16}H_{33}$ $R^1 = -C_4H_9$-t; Y-4

-continued
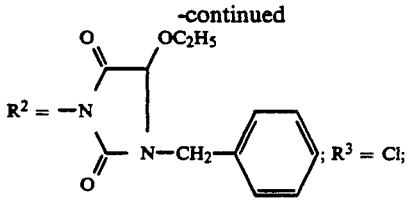
$R^4$ = H; $R^5$ = $-COOC_{12}H_{25}$
$R^1$ = $-C_4H_9$-t; Y-5
$R^2$ = H; $R^3$ = Cl;
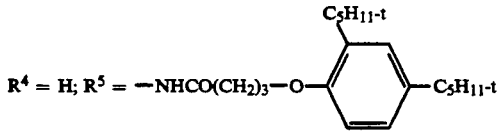
$R^1$ = $-C_4H_9$-t; Y-6
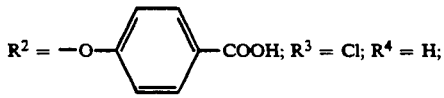
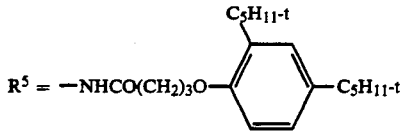
$R^1$ = $-C_4H_9$-t; Y-7
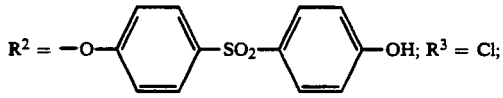
$R^4$ = H; $R^5$ = $-NHSO_2-C_{16}H_{33}$
$R^1$ = $-C_4H_9$-t; Y-8
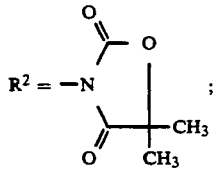
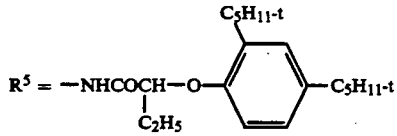
$R^1$ = $-C_4H_9$-t; Y-9
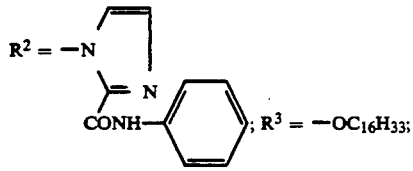
$R^4$ = H; $R^5$ = $-SO_2NHCOC_2H_5$
$R^1$ = $-C_4H_9$-t; Y-10
-continued
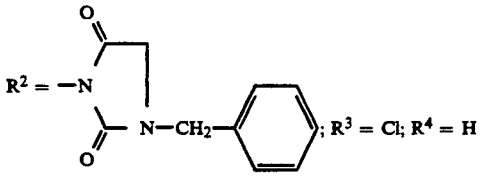
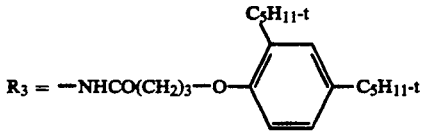
$R^1$ = $-C_4H_9$-t; Y-11
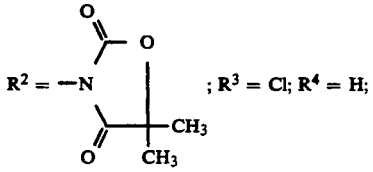
$R^5$ = $-COOCH(C_4H_9)-COOC_{12}H_{25}$
$R^1$ = $-C_4H_9$-t; Y-12
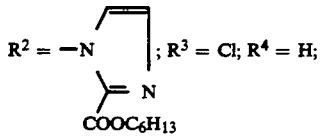
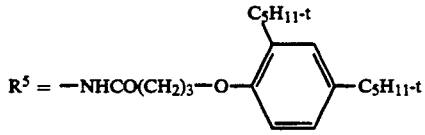
$R^1$ = $-C_4H_9$-t; Y-13
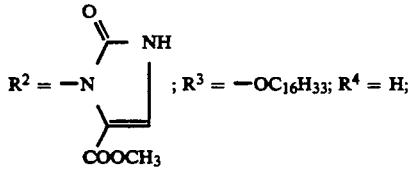
$R^5$ = $-SO_2NHCH_3$
$R^1$ = $-C_4H_9$-t; Y-14
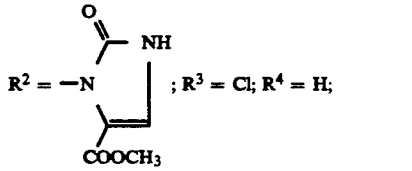
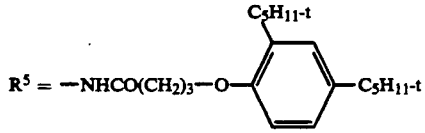

-continued

Y-15

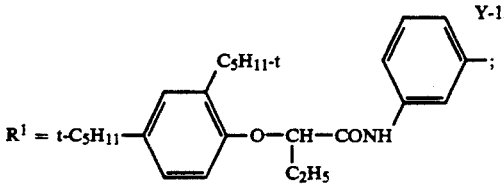

$R^2, R^4, R^5 = H; R^3 = -OCH_3$

Y-16

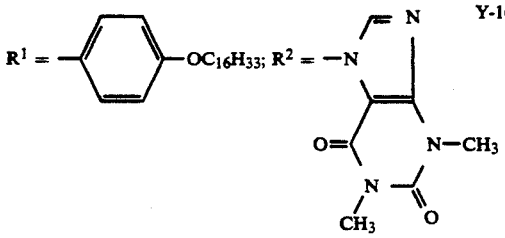

$R^3, R^5 = -OCH_3; R^4 = H$

Y-17

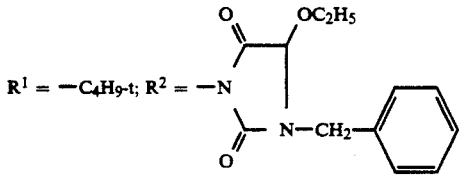

$R^3 = Cl; R^4 = H; R^5 = -COOC_{12}H_{25}$

Y-18

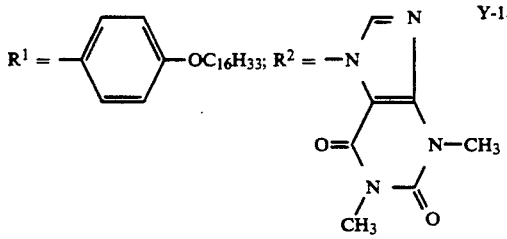

$R^3 = Cl; R^4, R^5 = -OCH_3$

Y-19

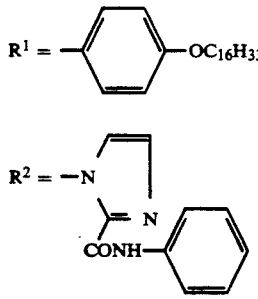

$R^3 = -OCH_3; R^4 = H; R^5 = -SO_2N(CH_3)_2$

Y-20

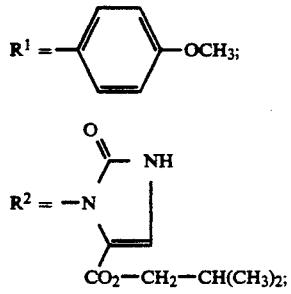

-continued $R^3 = -OCH_3; R^4 = H;$

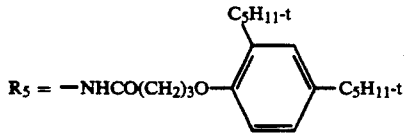

Y-21

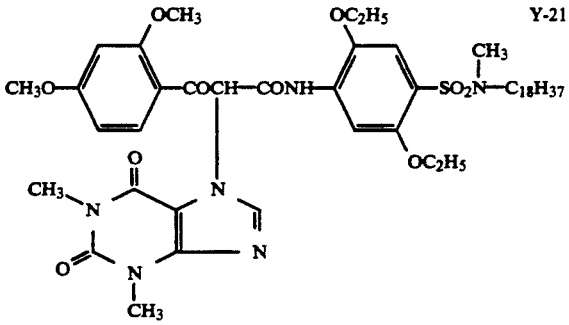

The color couplers may be 4-equivalent couplers and also 2-equivalent couplers. 2-Equivalent couplers are derived from the 4-equivalent couplers in that they contain in the coupling position a substituent which is eliminated during the coupling reaction. 2-Equivalent couplers include both those which are substantially colorless and also those which have a strong color of their own which either disappears during the color coupling reaction or is replaced by the color of the image dye produced (mask couplers).

The color couplers used in accordance with the invention are associated in the usual way with silver halide emulsion layers of different spectral sensitivity so that component dye images complementary in color to the color of the light used for exposure are produced.

The couplers or other compounds may be incorporated in the silver halide emulsion layers by initially preparing a solution, a dispersion or an emulsion of the particular compound and then adding it to the casting solution for the particular layer. The choice of a suitable solvent or dispersant depends upon the particular solubility of the compound.

Methods for introducing compounds substantially insoluble in water by grinding processes are described, for example, in DE-A-26 09 741 and DE-A-26 09 742.

Hydrophobic compounds may also be introduced into the casting solution using high-boiling solvents, so-called oil formers. Corresponding methods are described, for example in U.S. Pat. No. 2,322,027, U.S. Pat. No. 2,801,170, U.S. Pat. No. 2,801,171 and EP-A-0 043 037.

Instead of or in addition to the high-boiling solvents, it is also possible to use oligomers or polymers, so-called polymeric oil formers.

The compounds may also be introduced into the casting solution in the form of charged latices, cf. for example DE-A-25 41 230, DE-A-25 41 274, DE-A-28 35 856, EP-A-0 014 921, EP-A-0 069 671, Ep-A-0 130 115, U.S. Pat. No. 4,291,113.

Suitable oil formers are, for example, phthalic acid alkyl esters, phosphonic acid esters, phosphoric acid esters, citric acid esters, benzoic acid esters, amides, fatty acid esters, trimesic acid esters, alcohols, phenols, aniline derivatives and hydrocarbons.

Examples of suitable oil formers are dibutyl phthalate, dicyclohexyl phthalate, di-2-ethyl hexyl phthalate, decyl phthalate, triphenyl phosphate, tricresyl phosphate, 2-ethyl hexyl diphenyl phosphate, tricyclohexyl phosphate, tri-2-ethyl hexyl phosphate, tridecyl phosphate, tributoxyethyl phosphate, trichloropropyl phosphate, di-2-ethyl hexylphenyl phosphate, 2-ethylhexyl benzoate, dodecyl benzoate, 2-ethylhexyl-p-hydroxybenzoate, diethyl dodecaneamide, N-tetradecyl pyrrolidone, isostearyl alcohol, 2,4-di-tert.amylphenol, dioctyl acetate, glycerol tributyrate, isostearyl lactate, trioctyl citrate, N,N-dibutyl-2-butoxy-5-tert.-octyl aniline, paraffin, dodecylbenzene and diisopropyl naphthalene.

Each of the differently sensitized photosensitive layers of the negative material may consist of a single layer or may even comprise two or more partial silver halide emulsion layers (DE-C-1 121 470). Red-sensitive silver halide emulsion layers are often arranged nearer the layer support than green-sensitive silver halide emulsion layers which in turn are arranged nearer than blue-sensitive silver halide emulsion layers, a non-photosensitive yellow filter layer generally being present between green-sensitive layers and blue-sensitive layers.

In addition to the above-mentioned couplers for producing the various component dye images, the silver halide emulsion layers may also contain further additives, more particularly photographically active additives, such as antioxidants, white couplers, DIR couplers, DAR couplers FAR couplers and the like.

The non-photosensitive intermediate layers generally arranged between layers of different spectral sensitivity may contain agents to prevent unwanted diffusion of developer oxidation products from one photosensitive layer into another photosensitive layer with different spectral sensitization.

Suitable agents of the type in question, which are also known as scavengers or DOP trappers, are described in Research Disclosure 17 643 (December 1978), Chapter VII, 17 842 (February 1979) and 18 716 (November 1979), page 650 and in EP-A-0 069 070, 0 098 072, 0 124 877, 0 125 522.

The following are examples of particularly suitable compounds:

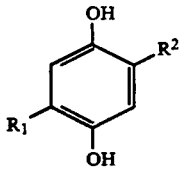

$R_1, R_2 = -C_8H_{17}$-t $-C_{12}H_{25}$-s $-C_6H_{13}$-t $-C(CH_3)_2-(CH_2)_3-COO-C_6H_{13}$ $-C_8H_{17}$-s $-C_{15}H_{31}$

-continued

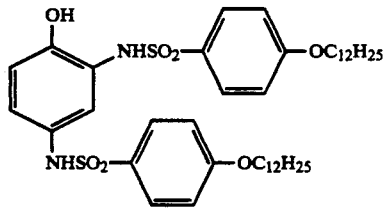

Where several partial layers of the same spectral sensitization are present, they may differ from one another in regard to their composition, particularly so far as the type and quantity of silver halide crystals is concerned. In general, the partial layer of higher sensitivity is arranged further from the support than the partial layer of lower sensitivity. Partial layers of the same spectral sensitization may be arranged adjacent one another or may be separated by other layers, for example by layers of different spectral sensitization. For example, all the high-sensitivity layers and all the low-sensitivity layers may be respectively combined to form a layer unit or layer pack (DE-A-19 58 709, DE-A-25 30 645, DE-A-26 22 922).

The photographic material may also contain UV absorbers, whiteners, spacers, filter dyes, formalin scavengers, light stabilizers, antioxidants, $D_{min}$ dyes, additives for improving dye, coupler and white stabilization and for reducing color fogging, plasticizers (latices), biocides and other additives.

UV-absorbing compounds are intended on the one hand to protect image dyes against fading under the effect of UV-rich daylight and, on the other hand, as filter dyes to absorb the UV component of daylight on exposure and thus to improve the color reproduction of a film. Compounds of different structure are normally used for the two functions. Examples are aryl-substituted benzotriazole compounds (U.S. Pat. No. 3,533,794), 4-thiazolidone compounds (U.S. Pat. Nos. 3,314,794 and 3,352,681), benzophenone compounds (JP-A-2784/71), cinnamic acid ester compounds (U.S. Pat. Nos. 3,705,805 and 3,707,375), butadiene compounds (U.S. Pat. No. 4,045,229) or benzoxazole compounds (U.S. Pat. No. 3,700,455).

Suitable formalin scavengers are, for example,

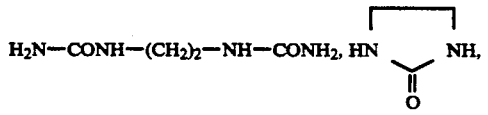

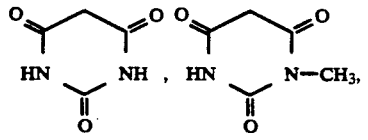

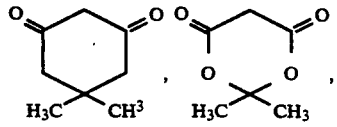

-continued

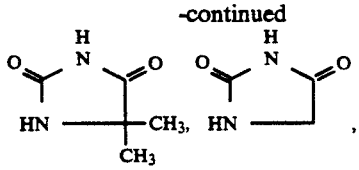

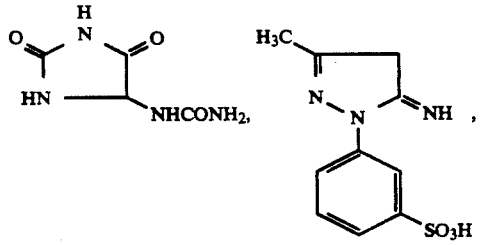

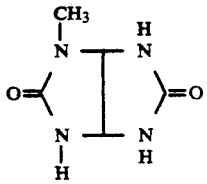

Additives for improving dye, coupler and White stability and for reducing color fogging (Research Disclosure 17 643/1978, Chapter VII) may belong to the following classes of chemical compounds: hydroquinones, 6-hydroxychromanes, 5-hydroxycoumaranes, spirochromanes, spiroindanes, p-alkoxyphenols, sterically hindered phenols, gallic acid derivatives, methylenedioxybenzenes, aminophenols, sterically hindered amines, derivatives containing esterified or etherified phenolic hydroxyl groups, metal complexes.

Compounds containing both a sterically hindered amine partial structure and also a sterically hindered phenol partial structure in one and the same molecule (U.S. Pat. No. 4,268,593) are particularly effective for preventing the impairment (deterioration or degradation) of yellow dye images as a result of the generation of heat, moisture and light. Spiroindanes (JP-A-159 644/81) and chromanes substituted by hydroquinone diethers or monoethers (JP-A-89 83 5/80) are particularly effective for preventing the impairment (deterioration or degradation) of magenta-red dye images, particularly their impairment (deterioration or degradation) as a result of the effect of light.

The following are examples of particularly suitable compounds:

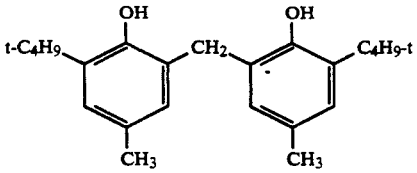

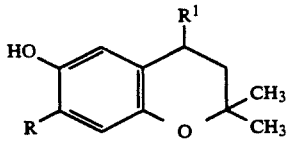

$R = -C_8H_{17}$-t; $R^1 = -CH_3$
$R = -C_8H_{17}$ ; $R^1 = -C_3H_7$-i

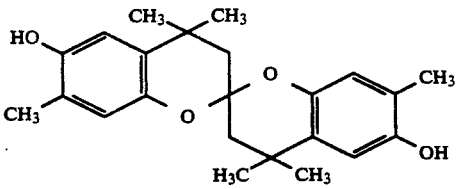

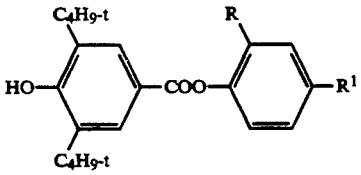

$R, R^1 = -C_4H_9$-t
$R, R^1 = -C_5H_{11}$-t

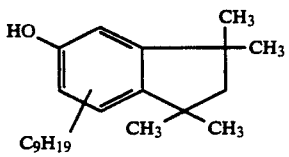

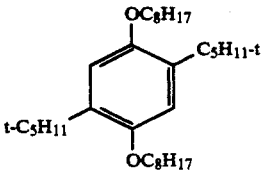

-continued

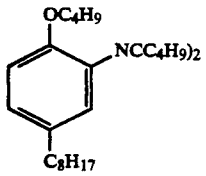

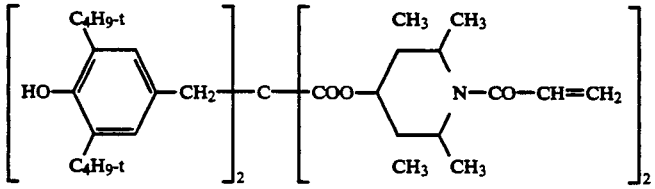

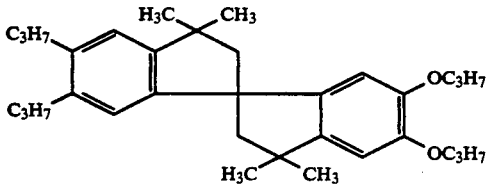

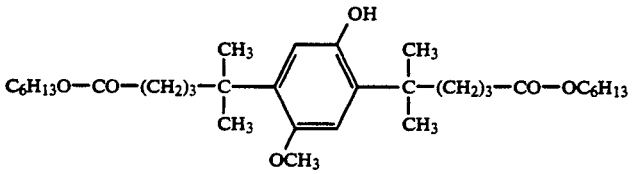

and the compounds mentioned as DOP trappers.

The layers of the photographic material may be hardened with the usual hardeners. Suitable hardeners are, for example, formaldehyde, glutaraldehyde and similar aldehyde compounds, diacetyl, cyclopentadione and similar ketone compounds, bis-(2-chloroethylurea), 2-hydroxy-4,6-dichloro-1,3,5-triazine and other compounds containing reactive halogen (U.S. Pat. No. 3,288,775, U.S. Pat. No. 2,732,303, GB-A-947,723 and GB-A-1,167,207), divinylsulfone compounds, 5-actyl-1,3-diacryloyl hexahydro-1,3,5-triazine and other compounds containing a reactive olefin bond (U.S. Pat. No. 3,635,718, U.S. Pat. No. 3,232,763 and GB-A-994,869); N-hydroxymethyl phthalimide and other N-methylol compounds (U.S. Pat. No. 2,732,316 and U.S. Pat. No. 2,586,168); isocyanates (U.S. Pat. No. 2,983,611); aziridine compounds (U.S. Pat. No. 3,017,280 and U.S. Pat. No. 2,983,611); acid derivatives (U.S. Pat. No. 2,735,294 and U.S. Pat. No. 2,725,295); compounds of the carbodiimide type (U.S. Pat. No. 3,100,740); carbamoyl pyridinium salts (DE-A-22 25 230 and DE-A-24 39 551); carbamoyloxy pyridinium compounds (DE-A-24 08 814); compounds containing a phosphorus-halogen bond (JP-A-113 929/83); N-carbonyloximide compounds (JP-A-43353/81); N-sulfonyloximido compounds (U.S. Pat. No. 4,111,926), dihydroquinoline compounds (U.S. Pat. No. 4,013,468), 2-sulfonyloxy pyridinium salts (JP-A-110 762/81), formamidinium salts (EP-A-0 162 308), compounds containing two or more N-acyloximino groups (U.S. Pat. No. 4,052,373), epoxy compounds (U.S. Pat. No. 3,091,537), compounds of the isoxazole type ( U.S. Pat. No. 3,321,313 and U.S. Pat. No. 3,543,292); halocarboxaldehydes, such as mucochloric acid; dioxane derivatives, such as dihydroxydioxane and dichlorodioxane; and inorganic hardeners, such as chrome alum and zirconium sulfate.

Hardening may be carried out in known manner by adding the hardener to the casting solution for the layer to be hardened or by overcoating the layer to be hardened with a layer containing a diffusible hardener.

Among the classes mentioned, there are slow-acting and fast-acting hardeners and also so-called instant hardeners which are particularly advantageous. Instant hardeners are understood to be compounds which crosslink suitable binders in such a way that, immediately after casting but at the latest 24 hours and, preferably 8 hours after casting, hardening has advanced to such an extent that there is no further change in the sensitometry and swelling of the layer combination as a result of the crosslinking reaction. By swelling is meant the difference between the wet layer thickness and dry layer thickness during aqueous processing of the film (Photogr. Sci. Eng. 8 (1964), 275; Photogr. Sci. Eng. (1972), 449).

These hardeners which react very quickly with gelatine are, for example, carbamoyl pyridinium salts which are capable of reacting with free carboxyl groups of the gelatine so that these groups react with free amino groups of the gelatine with formation of peptide bonds and cross-linking of the gelatine.

Suitable examples of instant hardeners are compounds corresponding to the following general formulae:

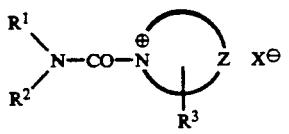

(a)

in which $R^1$ is alkyl, aryl or aralkyl, $R^2$ has the same meaning as $R^1$ or represents alkylene, arylene, aralkylene or alkaralkylene, the second bond being attached to a group corresponding to formula

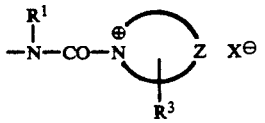

or $R^1$ and $R^2$ together represent the atoms required to complete an optionally substituted heterocyclic ring, for example a piperidine, piperazine or morpholine ring, the ring optionally being substituted, for example, by $C_{1-3}$ alkyl or halogen, $R^3$ is hydrogen, alkyl, aryl, alkoxy, $—NR^4—COR^5$, $—(CH_2)_m—NR^8R^9$, $—(CH_2)_n—CONR^{13}R^{14}$ or

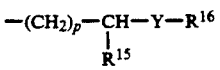

or is a bridge member or a direct bond to a polymer chain, $R^4$, $R^6$, $R^7$, $R^9$, $R^{14}$, $R^{15}$, $R^{17}$, $R^{18}$ and $R^{19}$ being hydrogen or $C_{1-4}$ alkyl, $R^5$ being hydrogen, $C_{1-4}$ alkyl or $NR^6R^7$, $R^6$ being $—COR^{10}$, $R^{10}$ being $NR^{11}R^{12}$, $R^{11}$ being $C_{1-4}$ alkyl or aryl, particularly phenyl, $R^{12}$ being hydrogen, $C_{1-4}$ alkyl or aryl, particularly phenyl, $R^{13}$ being hydrogen, $C_{1-4}$ alkyl or aryl, particularly phenyl, $R^{16}$ being hydrogen, $C_{1-4}$ alkyl, $COR^{18}$ or $CONHR^{19}$, m being a number of 1 to 3, n being a number of 0 to 3, p being a number of 2 to 3 and Y being O or $NR^{17}$ or $R^{13}$ and $R^{14}$ together representing the atoms required to complete an optionally substituted heterocyclic ring, for example a piperidine, piperazine or morpholine ring, the ring optionally being substituted, for example, by $C_{1-3}$ alkyl or halogen, Z being the C atoms required to complete a 5-membered or 6-membered aromatic heterocyclic ring, optionally with a fused benzene ring, and $X^{\ominus}$ is an anion which is unnecessary where an anionic group is already attached to the rest of the molecule;

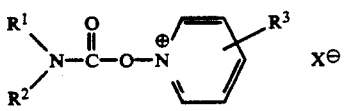

(b)

in which $R^1$, $R^2$, $R^3$ and $X^{\ominus}$ are as defined for formula (a).

There are diffusible hardeners which have the same hardening effect on all the layers of a layer combination. However, there are also non-diffusing, low molecular weight and high molecular weight hardeners of which the effect is confined to certain layers. With hardeners of this type, individual layers, for example the protective layer, may be crosslinked particularly highly. This is important where the silver halide layer is minimally hardened to increase the covering power of the silver and the mechanical properties have to be improved through the protective layer (EP-A 0 114 699).

Color photographic negative materials are normally processed by development, bleaching, fixing and washing or by development, bleaching, fixing and stabilization without subsequent washing; bleaching and fixing may be combined into a single process step. Suitable color developer compounds are any developer compounds which are capable of reacting in the form of their oxidation product with color couplers to form azomethine or indophenol dyes. Suitable color developer compounds are aromatic compounds containing at least one primary amino group of the p-phenylenediamine type, for example N,N-dialkyl-p-phenylenediamines, such as N,N-diethyl-p-phenylenediamine,1-(N-ethyl-N-methanesulfonamidoethyl)-3-methyl-p-phenylenediamine, 1-(N-ethyl-N-hydroxyethyl)-3-methyl-p-phenylenediamine and 1-(N-ethyl-N-methoxyethyl)-3-methyl-p-phenylenediamine. Other useful color developers are described, for example, in J. Amer. Chem. Soc. 73, 3106 (1951) and in G. Haist, Modern Photographic Processing, 1979, John Wiley and Sons, New York, pages 545 et seq.

Color development may be followed by an acidic stop bath or by washing.

The material is normally bleached and fixed immediately after color development. Suitable bleaches are, for example, Fe(III) salts and Fe(III) complex salts, such as ferricyanides, dichromates, water-soluble cobalt complexes. Particularly preferred bleaches are iron(III) complexes of aminopolycarboxylic acids, more especially for example ethylenediamine tetraacetic acid, propylenediamine tetraacetic acid, diethylenetriamine pentaacetic acid, nitrilotriacetic acid, iminodiacetic acid, N-hydroxyethyl ethylene diamine triacetic acid, alkyliminodicarboxylic acids, and of corresponding phosphonic acids. Other suitable bleaches are persulfates and peroxides, for example hydrogen peroxide.

The bleaching/fixing bath or fixing bath is generally followed by washing which is carried out in countercurrent or consists of several tanks with their own water supply.

Favorable results can be obtained where a following finishing bath containing little or no formaldehyde is used.

However, washing may be completely replaced by a stabilizing bath which is normally operated in countercurrent. Where formaldehyde is added, this stabilizing bath also performs the function of a finishing bath.

EXAMPLE 1

Quantities of 8 mmol coupler were dissolved in a ratio of 1:3 in ethyl acetate (EA) heated to approx. 50° C. Dibutyl phthalate (DBP) and Manoxol were then added so that the ratio of coupler to DBP to EA to Manoxol was 1:1:3:0.1. The mixture was then emulsified in 7.5% gelatine solution. The emulsate was stirred for 6 mins. at 1,000 r.p.m., undergoing an increase in temperature to approx. 50° C.; EA was filtered off under suction in a water jet vacuum (200–300 mbar).

The emulsates thus prepared were mixed with a silver bromide iodide emulsion (0.7 mol-% iodide) in a ratio of 1 mol coupler to 5.2 mol $AgNO_3$ and the resulting mixture was applied to a layer support of cellulose acetate and covered with a protective layer of a 3% gelatine solution containing a carbamoyl pyridinium betaine (CAS Reg. No. 65411-60-1). After drying and cutting up, the samples thus produced were exposed behind a step wedge and processed by the negative AP 70 process (38° C.).

| Bath | Mins. |
|---|---|
| Color developer (CD 70) | 3.25 |
| Bleaching bath | 6.5 |
| Rinsing | 3.0 |
| Fixing bath | 6.5 |
| Rinsing | 6.0 |

The following baths were used:

| | |
|---|---|
| Color developer | |
| 8000 ml | water |
| 17 g | hydroxyethane diphosphonic acid Na |
| 12 g | ethylenediamine tetraacetic acid (EDTA acid) |
| 47 g | 1-(N-ethyl-N-hydroxyethyl)-3-methyl-p-phenyl enediamine (CD 4) |
| 25 g | hydroxylammonium sulfate |
| 39 g | sodium sulfite |
| 15.5 g | sodium hydrogen carbonate |
| 335 g | potassium carbonate |
| 13.5 g | potassium bromide |
| | make up with water to 10 l; pH 10.0 |
| Bleaching bath | |
| 8000 ml | water |
| 1390 g | ammonium bromide |
| 865 g | EDTA $NH_4$-Fe |
| 163 g | EDTA acid |
| 100 g | ammonia |
| | make up with water to 10 l and adjust to pH 6.0 ± 0.1 with approx. 15 ml glacial acetic acid |
| Fixing bath | |
| 8000 ml | water |
| 1500 g | ammonium thiosulfate |
| 100 g | sodium sulfite |
| 20 g | sodium hexametaphosphate |
| | make up with water to 10 l; pH 7.5 |

Samples of the color layers thus prepared were taken in the density range D≦1–2 and the absorption spectrum was measured between quartz plates against the layer support as comparison sample in a Perkin-Elmer λ5 spectrophotometer at T≦23° C. 35° C. and 45° C. Examples of spectra thus obtained at T=23° C. (curve 1 -solid line) and 45° C. (curve 2 - chain line) are shown in FIGS. 2 to 5 for the couplers CC-1, CC-2, CC-3 and C-1. The coupler structures used and the numerical values are shown in Table 1.

Measurements of the reduction in density at the measuring station (scanning station) of the MSP printer with the original stationary are also shown in Table 1. The density values D are the average of 10 simultaneous measurements over the negative width of 35 mm at time $t=t_o$ and after 15 s (thermal equilibrium).

The highest dependence on temperature of the intensity and position of the absorption band is shown by the dye of the comparison coupler CC-1 (FIG. 2), the lowest by the dye of coupler C-1 according to the invention (FIG. 5).

In the temperature range T=23°–45° C., the absorption A of the dye changes reversibly with temperature in all the couplers (FIG. 6). At the absorption maximum, deviations of ±1–2 nm occur with the cycle T=23°→45°→35°→23° C., which is attributed to the complex environment of the dye (highly saturated solution in di-n-butylphthalate).

The measure of the temperature effect are the increases (ΔA/ΔT) and (Δλ/ΔT) which are described by the coefficients a and b.

In accordance with the dependence of density on temperature in the MSP printer, the following series was found for the temperature effect of the absorption measurements:

| | |
|---|---|
| | CC-1 > CC-3 > CC-2 > C-1 |
| a · (1 + b) = | 4.27 > 2.76 > 1.56 > 0.52 |
| ΔD (MSP) = | 0.09 > 0.05 > 0.02 > 0 |

A reduction in density of, for example, 0.09 at D=1.37 of the dye CC-1-CD4 is prohibitive in multicopy operation and is reflected in a distinct color tinge.

The dependence on temperature can be described more accurately by the absorption measurement because the measurement takes place spectrally in contrast to the integral printer measurement. Accordingly, the absorption measurements are preferentially shown in the following Examples.

TABLE 1
Dependence on temperature of the absorption of the CD 4 dyes of the cyan couplers
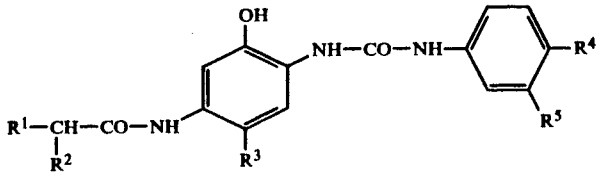
| Coupler | $R^1$ | $R^2$ | $R^3$ | $R^4$ | $R^5$ | D | ΔD | λ(T = 23° C.) nm | a | b | a · (1 + b) |
|---|---|---|---|---|---|---|---|---|---|---|---|
| CC-1 | 2,4-DitamphO* | $-C_4H_9$ | H | —F | H | 1.37 | 0.09 | 690.4 | 3.12 | 0.37 | 4.27 |
| CC-2 | 2,4-DitamphO | $-C_4H_9$ | H | —CN | —CN | 1.60 | 0.02 | 706.4 | 1.42 | 0.10 | 1.56 |
| CC-3 | 2,4-DitamphO | $-C_4H_9$ | H | —CN | H | 1.40 | 0.05 | 695.2 | 2.28 | 0.21 | 2.76 |
| C-1 | 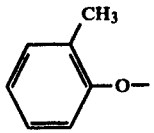 | $-C_{12}H_{25}$ | H | —CN | —CN | 1.55 | 0 | 690.9 | 0.47 | 0.10 | 0.52 |
| C-2 | 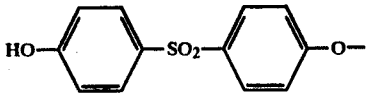 | $-C_{12}H_{25}$ | H | —CN | —CN | 1.60 | 0 | 711.7 | 0.65 | 0.15 | 0.75 |
| C-3 | 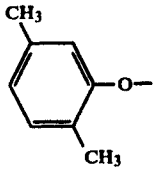 | $-C_{12}H_{25}$ | H | —CN | —CN | | | 659.8 | 0.84 | 0.07 | 0.90 |
| C-4 | 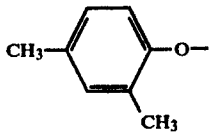 | $-C_{10}H_{21}$ | H | —CN | —CN | | | 680.5 | 1.31 | 0.11 | 1.45 |
| C-5 | 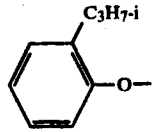 | $-C_{12}H_{25}$ | H | —CN | —CN | 2.12 | 0.03 | 698.3 | 1.31 | 0.06 | 1.39 |

TABLE 1-continued
Dependence on temperature of the absorption of the CD 4 dyes of the cyan couplers
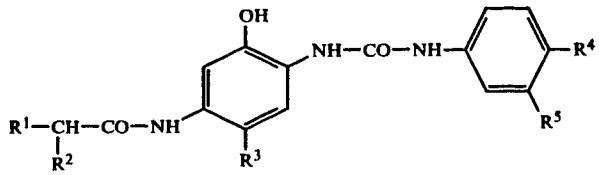
| Coupler | $R^1$ | $R^2$ | $R^3$ | $R^4$ | $R^5$ | D | ΔD | λ(T = 23° C.) nm | a | b | a · (1 + b) |
|---|---|---|---|---|---|---|---|---|---|---|---|
| C-6 | 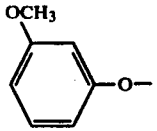 | $-C_{12}H_{25}$ | H | —CN | —CN | | | 688.9 | 1.09 | 0.18 | 1.29 |
| C-7 | 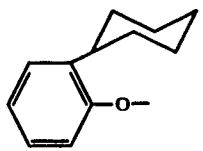 | $-C_{12}H_{25}$ | H | —CN | —CN | 2.19 | 0.04 | 689.7 | 1.24 | 0.07 | 1.33 |
| C-8 | 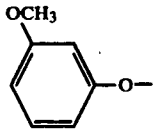 | $-C_{12}H_{25}$ | H | —CN | H | | | 678.8 | 1.21 | 0 | 1.21 |
| CC-4 | 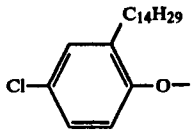 | $-C_2H_5$ | H | —CN | —CN | 1.80 | 0.01 | 688.2 | 1.66 | 0.07 | 1.78 |
| CC-5 | 2,4-DitamphO | $-C_4H_9$ | 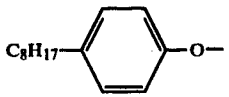 | —CN | —CN | 2.06 | 0.01 | 707.0 | 1.74 | 0.19 | 2.07 |

TABLE 1-continued
Dependence on temperature of the absorption of the CD 4 dyes of the cyan couplers
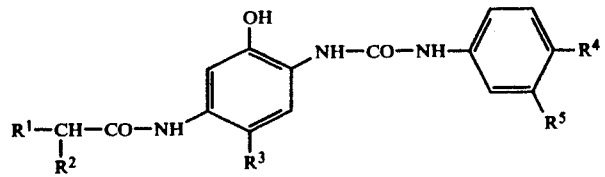
| Coupler | $R^1$ | $R^2$ | $R^3$ | $R^4$ | $R^5$ | D | ΔD | λ(T = 23° C.) nm | a | b | a · (1 + b) |
|---|---|---|---|---|---|---|---|---|---|---|---|
| CC-6 | 2,4-DitamphO | $-C_4H_9$ | 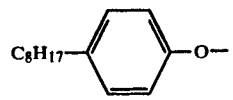 | —CN | —CN | 2.25 | 0.04 | 708 | 1.95 | 0.26 | 2.46 |
| CC-7 | 2,4-DitamphO | $-C_3H_7$ | H | —CN | —CN | 2.74 | 0.01 | 710.4 | 1.96 | 0.08 | 2.12 |
| CC-8 | 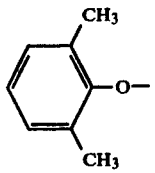 | $-C_{12}H_{25}$ | H | —CN | —CN | | | 656.5 | 2.03 | 0.05 | 2.13 |
| CC-9 | 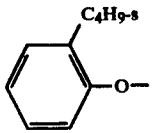 | $-C_{12}H_{25}$ | H | —CN | —CN | | | 694.6 | 1.84 | 0.08 | 1.99 |
| CC-10 | 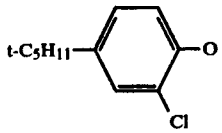 | $-C_6H_{13}$ | H | —CN | —CN | | | 690.9 | 3.47 | 0.13 | 3.92 |
| CC-11 | 2,4-DitamphO | $-C_4H_9$ | H | —CN | H | 1 26 | 0 05 | 695.2 | 2.35 | 0.24 | 2.91 |
| CC-12 | 2,4-DitamphO | $-C_6H_{13}$ | H | —CN | H | | | 696.1 | 1.26 | 0.20 | 1.51 |
| CC-13 | 2,4-DitamphO | $-C_6H_{13}$ | 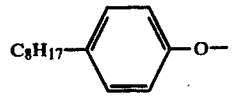 | —CN | H | | | 696.4 | 2.18 | 0.37 | 2.99 |

TABLE 1-continued
Dependence on temperature of the absorption of the CD 4 dyes of the cyan couplers
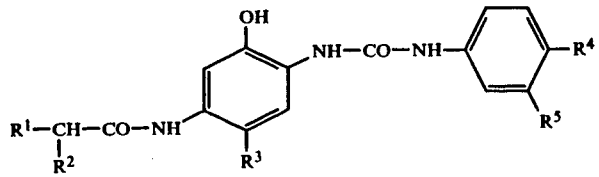
| Coupler | $R^1$ | $R^2$ | $R^3$ | $R^4$ | $R^5$ | D | ΔD | λ(T = 23° C.) nm | a | b | a · (1 + b) |
|---|---|---|---|---|---|---|---|---|---|---|---|
| CC-14 | 2,4-DitamphO | $-C_4H_9$ | H | Cl | —CN | | | 693.9 | 1.87 | 0.12 | 2.09 |
| CC-15 | 2,4-DitamphO | $-C_3H_7$-i | H | —CN | H | | | 698.2 | 3.05 | 0.29 | 3.93 |
*) 2,4-DitamphO stands for 2,4-Di-t-amylphenoxy
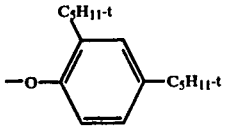

EXAMPLE 2

Photographic layers containing the couplers mentioned in Table 2 (magenta and yellow) were prepared in accordance with Example 1 and processed and evaluated as described therein. The results are shown in Table 2.

TABLE 2

Dependence on temperature of the absorption of the CD 4 dyes of the couplers (magenta and yellow)

| Coupler | D | ΔD | λ(T = 23° C.) [nm] | a | b | a · (1 + b) |
|---|---|---|---|---|---|---|
| M-12 | 0.86 | 0.01 | 551.1 | 0.87 | 0.11 | 0.97 |
| M-18 | 0.86 | 0.01 | 552.9 | 0.51 | 0.16 | 0.59 |
| M-22 | 1.25 | 0.01 | 547.8 | 0.86 | 0.20 | 1.03 |
| M-23 | 0.85 | 0.02 | 554.1 | 0.43 | 0.10 | 0.47 |
| M-24 | 1.29 | 0.02 | 551.0 | 0.48 | 0.19 | 0.57 |
| Y-5 | | | 447.7 | 1.26 | 0.06 | 1.34 |
| Y-17 | | | 451.0 | 0.90 | 0.21 | 1.09 |
| Y-19 | | | 451.6 | 1.83 | 0.21 | 2.21 |

Figure 1:
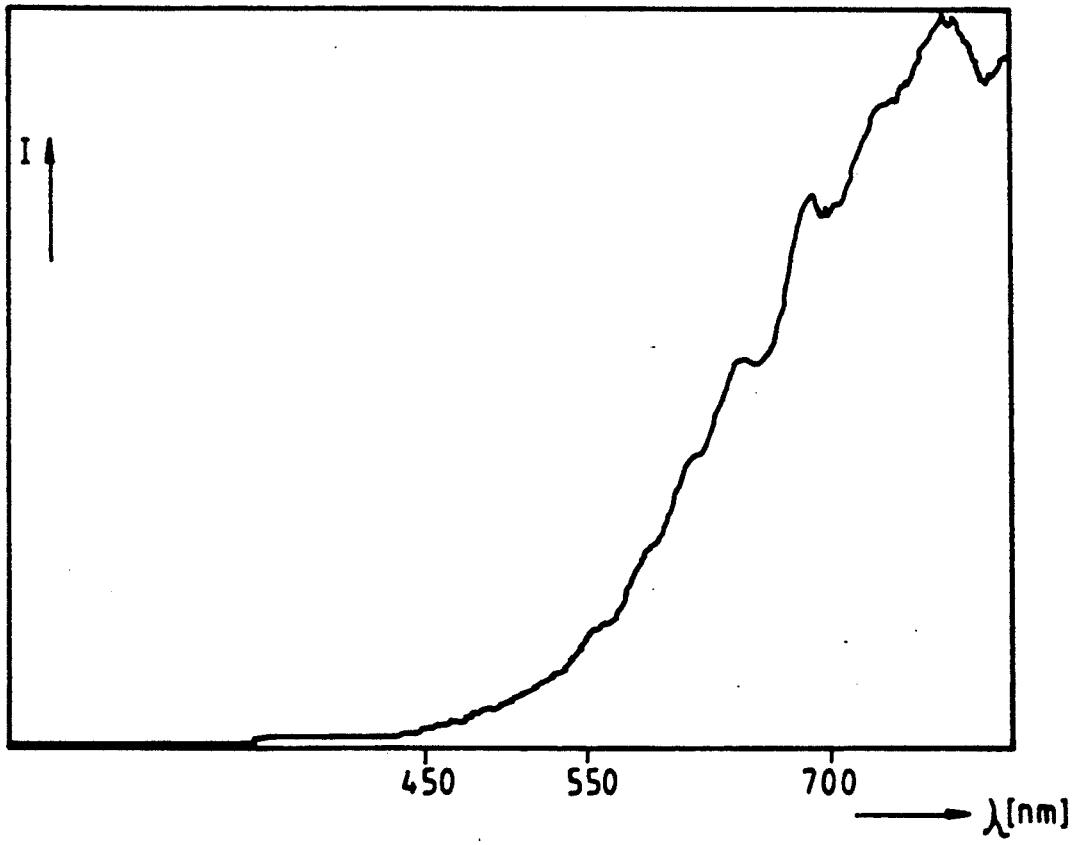
FIG. 1 shows variation of radiant power with spectral region.
Figure 2:
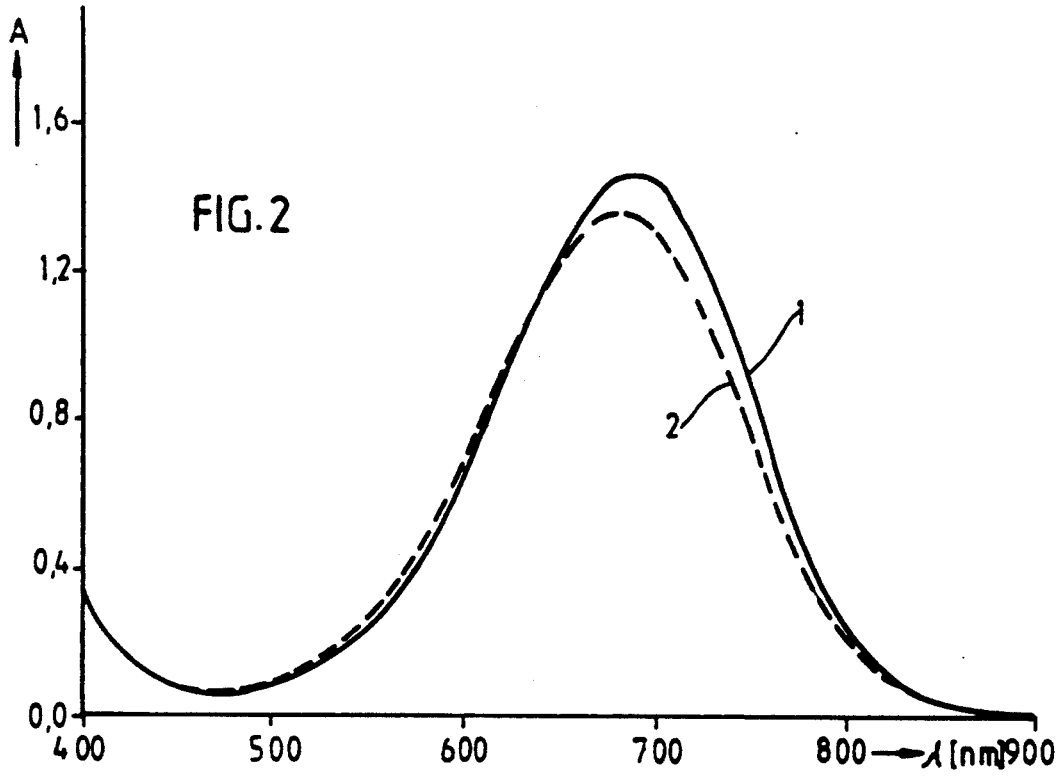
FIGS. 2–6 show the spectral absorption of dyes used in the examples.
Figure 3:
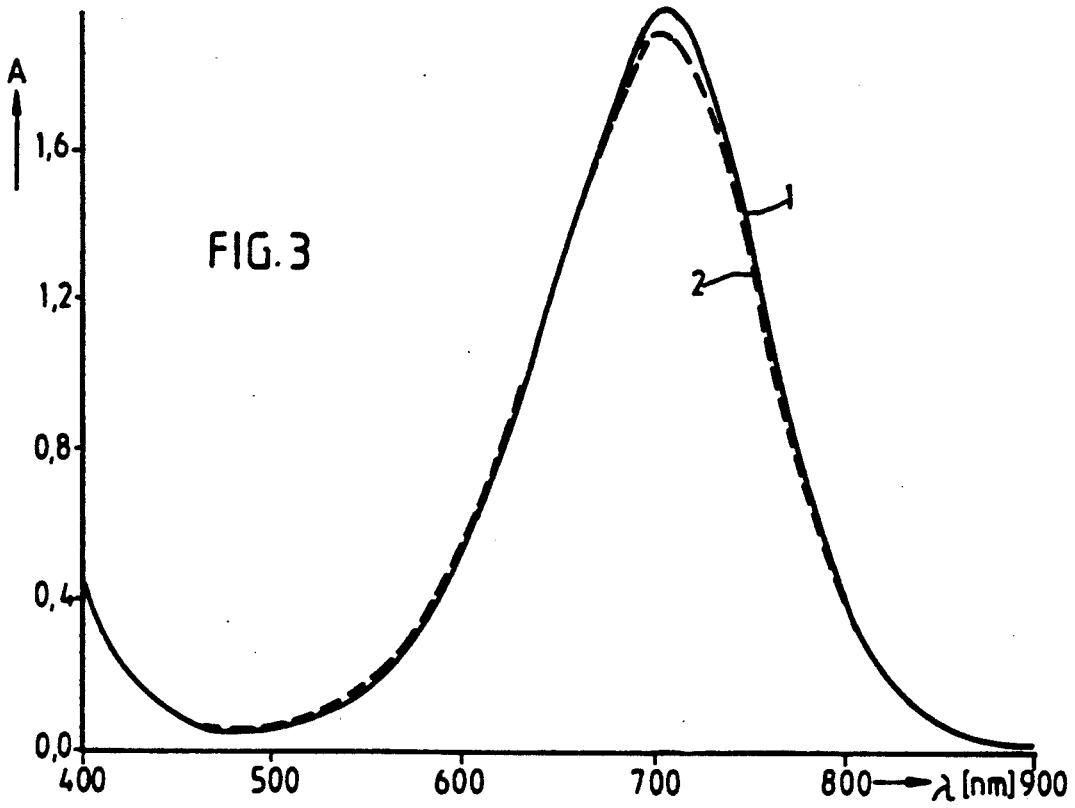
Figure 4:
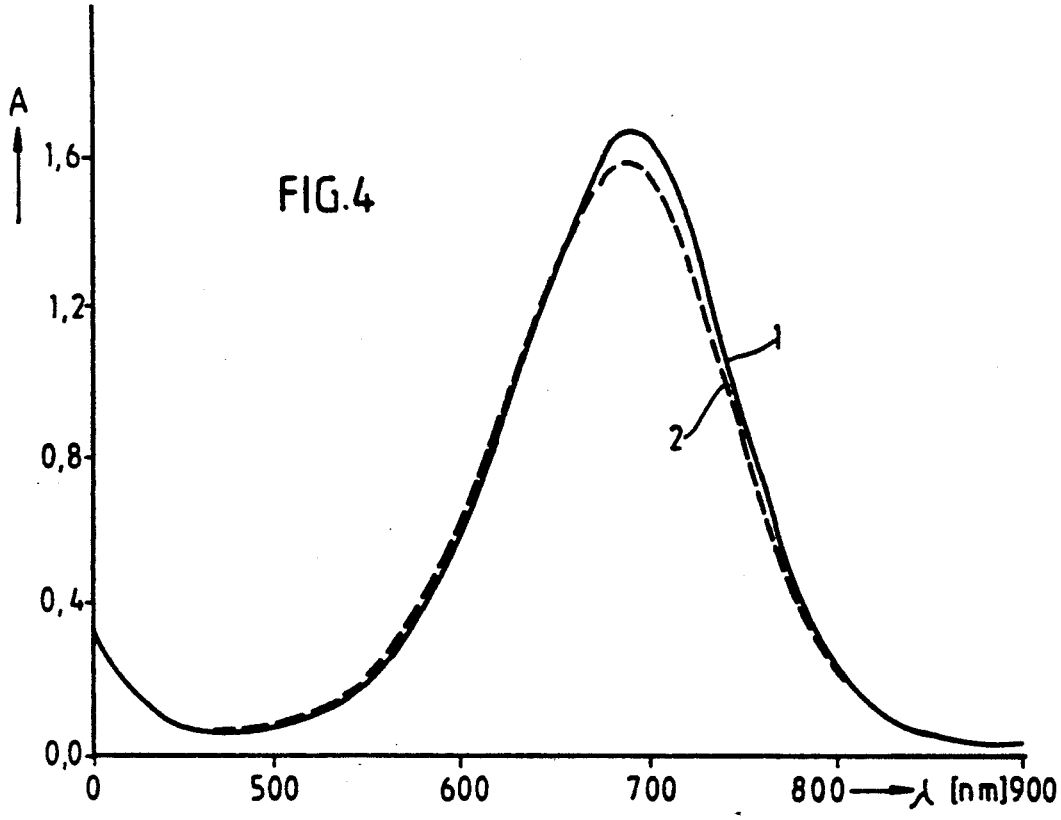
Figure 5:
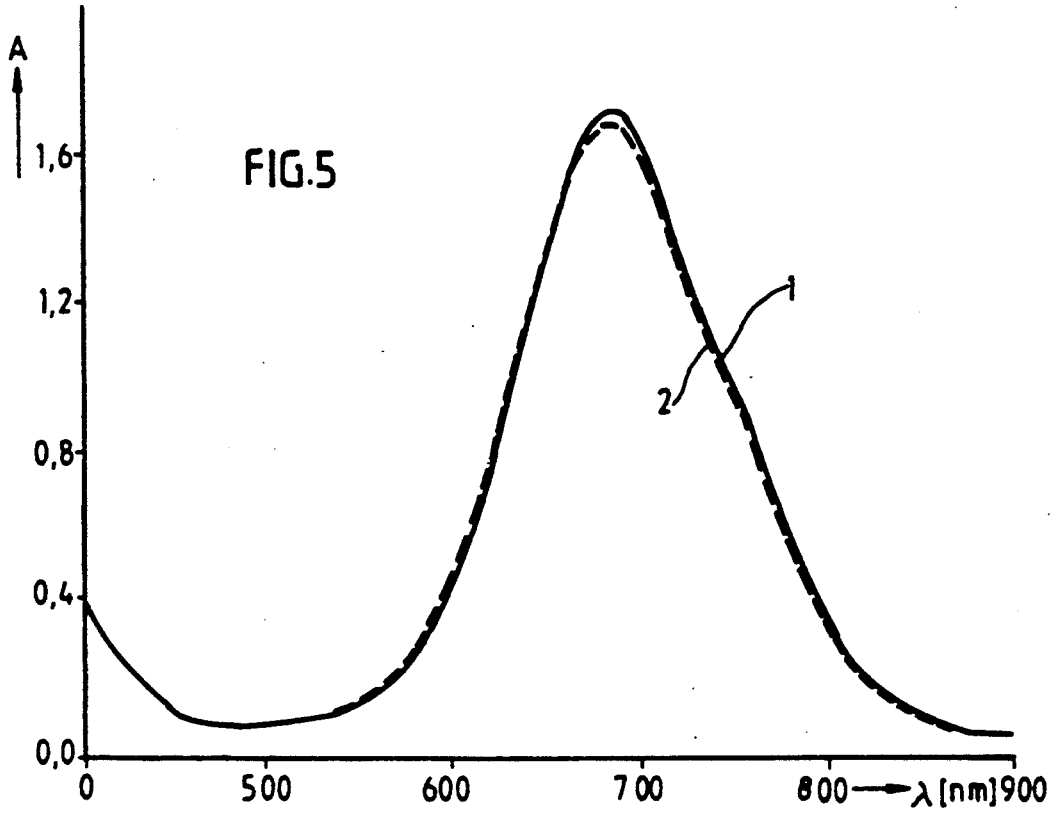
Figure 6:
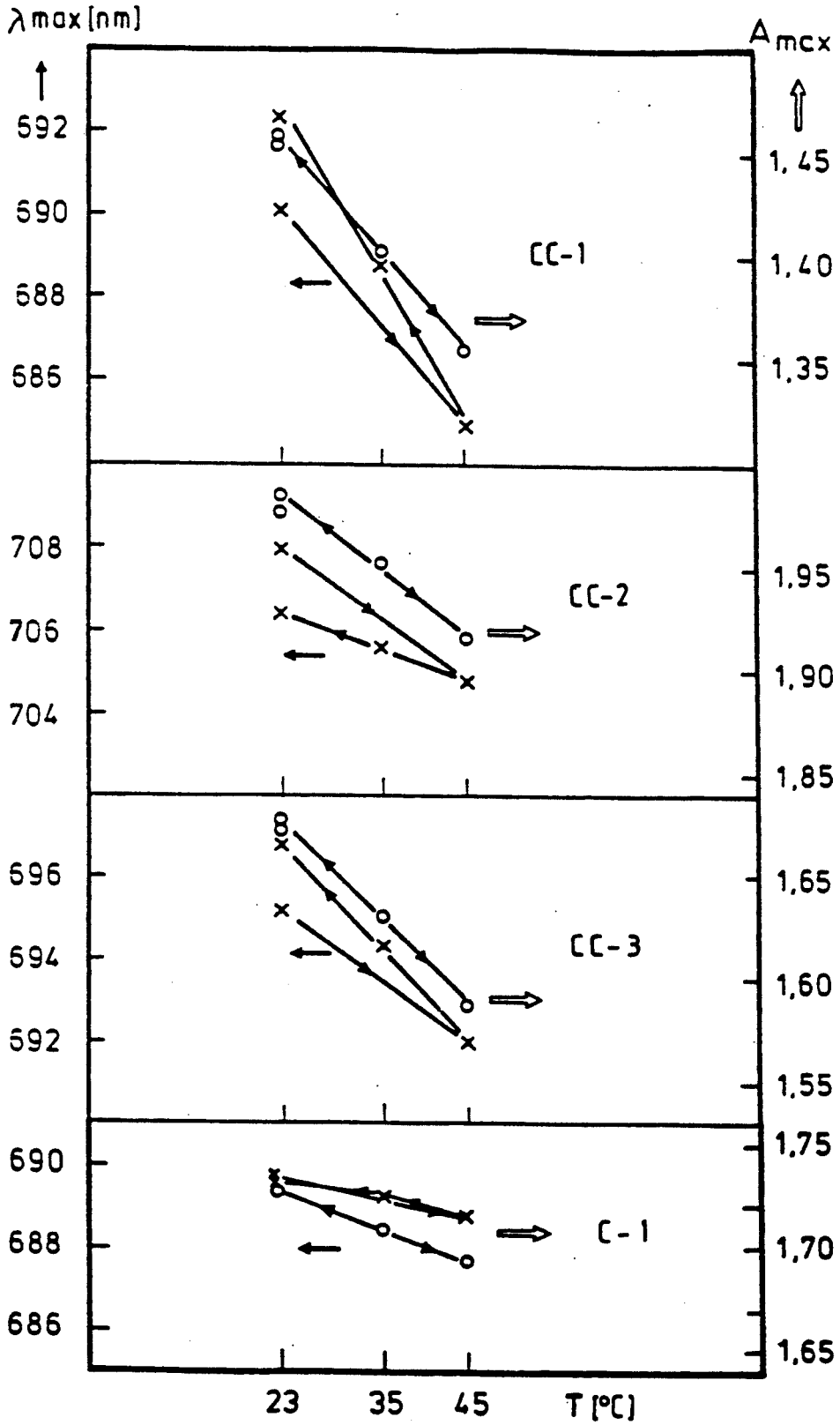

We claim:

1. A color photographic recording material which contains on a transparent layer support at least one red-sensitive halide emulsion layer and a cyan coupler of the phenol type associated therewith, at least one green-sensitive silver halide emulsion layer and a magenta coupler of the 5-pyrazolone or pyrazoloazole type associated therewith and at least one blue-sensitive silver halide emulsion layer and a yellow coupler of the acylacetanilide type associated therewith, characterized in that the following condition applies to the cyan dye formed from the cyan coupler in the layer during chromogenic development:

$$a\cdot(1+b)\leqq 1.5$$

where a is the temperature coefficient of the absorption $$A_{(T=23^\circ C.)} = \lg\frac{I_o}{I}$$

($I_o$ and I representing the spectral radiant flux respectively in front of and behind the sample)

$$a = -\left[\frac{1}{A}\right]\cdot\left[\frac{\Delta A}{\Delta T}\right]\cdot 1{,}000$$

wherein (ΔA/ΔT) is the change of absorption per °C., i.e. the measured absorption difference ΔA caused by the temperature difference ΔT, standardized to the absorption A at T=23° C., and b is the temperature coefficient of the absorption wavelength λ(T=23° C.)

$$b = -\left[\frac{1}{\lambda}\right]\cdot\left[\frac{\Delta\lambda}{\Delta T}\right]\cdot 1{,}000$$

wherein (Δλ/ΔT) is the change in wavelength per °C., i.e. the measured wavelength difference Δλ caused by the temperature difference ΔT, standardized to the wavelength λ max at T=23° C. and λ is the wavelength of maximum absorption of the formed dye and the cyan coupler corresponds to formula II

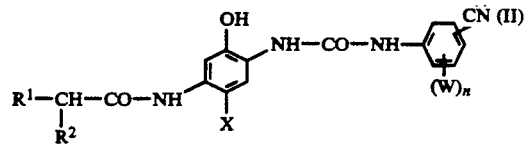

in which

W represents H or another substituent;

n has a value of 1 to 4;

$R^1$ represents a phenoxy group which has at least one unsubstituted o-position on the phenyl ring and, in addition may be substituted by 1 to 3 substituents from the group consisting of $C^{1-3}$ alkyl, alkoxy or cycloalkyl;

$R^2$ represents alkyl containing at least 8 C atoms,

X represents hydrogen, halogen or a group releasable during the color coupling reaction.

2. A recording material as claimed in claim 1, characterized in that the following condition also applies to the magenta dye formed from the magenta coupler during chromogenic development in the layer and to the yellow dye formed from the yellow coupler during chromogenic development in the layer:

$$a\cdot(1+b)\leqq 1.5$$

where a is the temperature coefficient of the absorption $$A_{(T=23^\circ C.)} = \lg\frac{I_o}{I}$$

($I_o$ and I representing the spectral radiant flux respectively in front of and behind the sample)

$$a = -\left[\frac{1}{A}\right]\cdot\left[\frac{\Delta A}{\Delta T}\right]\cdot 1{,}000$$

wherein (ΔA/ΔT) is the change of absorption per °C., i.e. the measured absorption difference ΔA caused by the temperature difference ΔT, standardized to the absorption A at T=23° C., and b is the temperature coefficient of the absorption wavelength $\lambda_{(T=23^\circ C.)}$ $$b = -\left[\frac{1}{\lambda}\right]\cdot\left[\frac{\Delta\lambda}{\Delta T}\right]\cdot 1{,}000$$

wherein (Δλ/ΔT) is the change in wavelength per °C., i.e. the measured wavelength difference Δλ caused by the temperature difference ΔT, standardized to the wavelength λ max at T-23° C. and λ is the wavelength of maximum absorption of the formed dye.

* * * * *